United States Patent [19]

Fox et al.

[11] 4,308,191

[45] Dec. 29, 1981

[54] FOUNDRY SAND MIXES WITH IMPROVED BENCH LIFE FOR CURING WITH SULFUR DIOXIDE OR OTHER OXIDIZABLE GASEOUS CATALYSTS

[75] Inventors: Robert H. Fox, Elgin; Roger H. Kottke, Crystal Lake; James E. Menting, Algonquin; R. Bruce Sampsell, Chicago, all of Ill.

[73] Assignee: The Quaker Oats Company, Chicago, Ill.

[21] Appl. No.: 123,877

[22] Filed: Feb. 25, 1980

[51] Int. Cl.[3] ..... B22C 1/22; B22C 9/02; C08K 3/32; C08L 71/06

[52] U.S. Cl. ..... 260/37 R; 260/42.43; 260/998.18

[58] Field of Search ..... 260/998.18, DIG. 40, 260/42.43, 37 R

[56] References Cited

U.S. PATENT DOCUMENTS 3,681,287 8/1972 Brown et al. ..... 260/998.18
3,879,339 4/1975 Richard ..... 260/DIG. 40

*Primary Examiner*—Allan Lieberman
*Attorney, Agent, or Firm*—Joseph P. O'Halloran

[57] ABSTRACT

Foundry sand mixes comprising a mixture of sand, binder, and hydrogen peroxide are improved with respect to bench life by the addition thereto, at the time of initial preparation of the mixture, of non-catalyzing amounts, but stabilizing amounts, of certain iron chelating agents which are acid or salts of acids selected from those which, in their free acid form, have an acidic pH less than 3.0 when dissolved at 1 percent weight per weight in water or when saturated in water, whichever is lower in concentration.

21 Claims, No Drawings

FOUNDRY SAND MIXES WITH IMPROVED BENCH LIFE FOR CURING WITH SULFUR DIOXIDE OR OTHER OXIDIZABLE GASEOUS CATALYSTS

BACKGROUND OF INVENTION

Furan resin binders, that is resins produced from furfuryl alcohol, have found world-wide use as sand binders in the production of foundry sand shapes. These furan resins typically undergo rapid polymerization or curing in the presence of acid catalyst.

One of the problems encountered in the foundry in connection with the use of furan resin has been the fact that the resins are indeed so reactive in acid systems. The premixing of catalyst, and binder with the sand prior to placement of the sand mix in sand shaping elements sometimes results in a mixture with relatively short "bench life." A recent development which appears to be gaining world-wide acceptance is described in U.S. Pat. No. 3,879,339 issued to Richard, involves the elimination of the acid catalyst from the formulation of the sand-binder system which exists prior to placement in the sand shaping element. In the latter method the binder and sand are admixed to include a peroxide to provide a sand, binder, and peroxide mixture which contains no polymerization catalyst. This mixture is placed in the shaping element. Thereafter, the thus shaped sand mix is exposed to sulfur dioxide gas or other oxidizable gaseous catalyst, for example, by blowing a gas mixture containing sulfur dioxide or other oxidizable gaseous catalyst through the sand shape. Apparently because of the presence of the peroxide, an acid catalyst is formed instantaneously from the sulfur dioxide and the sand shape substantially instantaneously is cured into a high strength integral solid.

However, even though the peroxide-binder-sand mixes which are used in accordance with the Richard method contain no catalyst it has been found that these mixes may not exhibit prolonged bench life when hydrogen peroxide, for example, is used as the peroxide. For example, a freshly mixed hydrogen peroxide-binder-sand mixture when gassed with $SO_2$ will typically produce sand shapes having tensile strength in order of 100–300 psi. On the other hand, these same uncured sand mixes, when placed, for example, 3–6 hours after they are mixed, and when then gassed with the same level of $SO_2$, often produced sand shapes which are either totally uncured, or are of inadequate tensile strength to use in a foundry within a reasonable period of cure time. The whole point of the $SO_2$ gassing method is to produce a sand shape which is instantaneously useable, and a major advantage of the $SO_2$ gassing method is lost unless, as an immediate consequence of the gassing step, the sand shape is of sufficient strength to be handleable and to be useful in the foundry.

On the other hand, many, if not most, foundries are set up to involve day-to-day shift operations in which the sand mixes are produced in very large quantities at one or two times during the work shift. The pre-prepared mixes are stored in large hoppers and are dispensed, from time to time, for distribution to a work station at which portions of the sand pre-mix are placed in sand shaping elements and gassed.

Thus, it has been unfortunate that, when the peroxide used is the most desirable peroxide from an economic viewpoint, i.e. hydrogen peroxide, it has been found that the pre-made peroxide-binder-sand mixes do not reliably retain their "vitality" for use in the $SO_2$ gassing process for the periods of time which would be amenable to usual foundry practices, particularly when some lower quality sands are employed. It is unfortunate that, in such systems heretofore available, as the hours pass portions of such sand mixes taken from the main storage hopper were found to have produced sand shapes of decreasing tensile strength, until finally the sand shapes formed therefrom remain virtually unhandleable immediately after the gassing step.

It would be highly desirable to improve the technology surrounding the $SO_2$ gassing method to provide sand mixes which will retain their "vitality" and remain useable throughout at least a half of a working shift, and preferably throughout an entire working shift, e.g. 4–8 hours.

On the other hand, the improvement in the technology must be very economical and entirely amenable and adaptable to routine foundry practice. In addition, whatever changes are involved should not result in a substantial lessening of the tensile strengths of the sand shapes produced in the method, but result in a prolongation of the period of time known as bench life, in which high strength sand shapes are produced immediately upon the $SO_2$ gassing step.

SUMMARY OF THE INVENTION

These and other improvements in the $SO_2$ gassing technology are all achieved in accordance with the improvement of the present invention in which the sand mix has incorporated into it an iron chelating agent having a log $K_{(stab)}$ greater than 15, preferably greater than 20, said chelating agent being an acid or salt of an acid having an acidic pH<3 in a solution of about 1 percent by weight or saturated, whichever is lower concentration, at 25° C.

Any iron chelating agents which meet these qualifications are in accordance with the invention, and the following exemplary agents are provided, not to limit, but to illustrate the practice of the invention.

One class of exemplary iron chelating agents which are useful in accordance with the present invention have the chemical structure:

STRUCTURE I

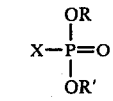

wherein; R and R′ is hydrogen or metal ions which result in the structure providing a water soluble compound; and X is OH or an organic moiety including alkyl substituents, e.g. aminotri (methylene phosphonic), or aromatic substitutents, e.g. phenyl phosphonic acid. Also, compounds which, in the presence of water give compounds containing Structure I, are also useful stabilizers in accordance with this invention. Thus $P_2O_5$ is a useful additive because, in the presence of the aqueous hydrogen peroxide, it is converted to $H_3PO_4$, a compound in accordance with Structure I. Exemplary specific compounds useful in accordance with this invention and having the Structure I include phosphoric acid, phosphorous acid, sodium and/or ammonium dihydrogen phosphate, and numerous organic chelating agents such as, for example, commercially available materials having formulae of Structure II, such as, for example Dequest 2000 aminotri (methylene phosphonic) (see Structure IIb), Dequest 2051 (see Structure IIc), Dequest 2010 (see Structure IIa), and 2060 (see Structure IId) (registered T.M. of Monsanto Company). The structural formulae for such compounds are reported to be as follows:

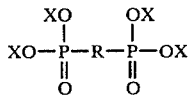

where X=H or a metal salt and R= as defined in IIa through IId, below.

STRUCTURE IIa

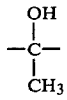

STRUCTURE IIb

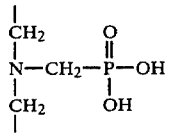

STRUCTURE IIc

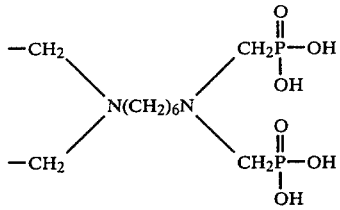

STRUCTURE IId

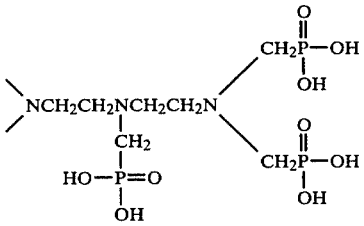

Also useful as a chelating agent in accordance with this invention, is phenyl phosphonic acid, which is commercially available as Mobil PA-75 (T.M. Mobil Chemical Company). The penta sodium salt of Dequest 2000 (see Structure IIb, has a pH of 10–11 when in a 1 percent solution at 25° C. is available as Dequest 2006 (T.M. Monsanto Industrial Chemicals, Co.) and is useful in accordance with this invention as a stabilizer.

As used herein "salts" refer to the water soluble salts, and, generally comprise sodium, ammonium or similarly water soluble salts.

As used herein, the "stability constant" is the value reported in conventional terms wherein the log stability constant=log $K_{(stab)}$=

$$\log\left[\frac{[(ML)]}{[M]\,[L]}\right],$$

where [M] is the total concentration of metal in solution that is not chelated, [L] is the concentration of total free chelating agent, and (ML) is the total metal chelate concentration. Typically the stability constants represent the value achieved when only the complexing agent and the iron salts are present in the solution, and represent the then prevaling pH conditions. (See *Complexation in Analytical Chemistry,* Anders Ringborn, Interscience Publishers, New York, 1963 esp. pages 36, 37.)

All the specifically named compounds and structures named above, meet the log $K_{(stab)}$ and acidity requirements set forth above in accordance with this invention.

Surprisingly, many of the outstanding hydrogen peroxide stabilization agents, and iron chelating agents not in accordance with this invention, are substantially totally ineffective in improving the $SO_2$ gassing technology in accordance with this invention. For example, 8-hydroxyquinoline, a widely known hydrogen peroxide stabilization agent and an outstanding iron chelating agent was found to be substantially totally ineffective with respect to prolonging the bench life of a hydrogen peroxide-furan resin-sand mixture for use in the $SO_2$ gassing processes.

In addition, another hydrogen peroxide stabilizer disclosed in U.S. Pat. No. 4,140,772, namely saccharin, has been found to be substantially ineffective in improving the $SO_2$ gassing technology in accordance with this invention.

In addition, numerous inorganic peroxide stabilizers such as, for example, tin oxide and others have been tried but have been found to be ineffective with respect to improving the stabilization of the peroxide-containing sand mix for use in the $SO_2$ gassing processes.

The optimum amount of the useful life additive (ULA) which is added in accordance with the present invention is a stabilizing, non-catalyzing amount, the range of which is readily determined for a particular sand mix, and for a particular ULA, by simple experimentation.

For example, when a very pure sand, such as Wedron silica sand is used as the foundry sand, 1.5 percent phosphoric acid based on the binder, extended the useful life of the sand-furan resin binder-hydrogen peroxide mix (as compared to the useful life with no additive), from about 3 hours without the additive to about 8 hours with the ULA added. On the other hand, a Michigan lake sand which is generally regarded as a less pure grade of sand, without ULA added in accordance with the present invention gave a useful life of about 0.5 hours, but with ULA consisting of 1.5 percent phosphoric acid w/w based on the binder, extended the useful life to about 2 to 4 hours, and with 3 percent phosphoric acid w/w based on the binder gave about 6 hours or longer.

Thus the specific optimum amount of the ULA which is added in accordance with the present invention to provide a stabilizing amount, and yet a non-catalyzing amount, with respect to the curing of the resin, is believed to depend on the amount of impurities in the sand mix, but this invention is tied to no particular theory. Nonetheless, it is appreciated that the useful life of the peroxide-binder-sand mixes for use in the $SO_2$ gassing cure methods, both with high purity silica sand, and lake sand of lesser purity, are profoundly improved.

It will be appreciated, however, by those skilled in foundry art, that some type of sands (high acid demand sands) are heavily loaded with alkaline or acid consuming impurities, and that these sands are unsuitable for use with any process requiring acid catalysis. The method of the present invention inherently depends on the functioning of the acid formed in place in the mix, and such "high acid demand" sands are naturally not suitable for use in this method.

One of the shortcomings of the $SO_2$ gassing method is that the bench life which is observed for a particular mixture of a particular foundry sand, hydrogen peroxide, in a particular furfuryl alcohol resin is not predictable inasmuch as the useful life appears to be sensitive to the individual but undefined and unappreciated variables or parameters involved in the mixing in specific foundries. We have discovered that mixing time has a profound adverse effect on the bench life, and that the drop in strength for a given amount of excess mix time becomes even greater as the bench time is increased. Thus excess mixing time is to be avoided.

Thus, as indicated above, this invention is not postulated on the basis of any particular theory, but on the fact that it has worked. Surprisingly, even though acids, when present in higher, catalytic concentrations lead to the polymerization of furan resin binders, the lower non-catalyzing concentrations, in accordance with this invention, actually stabilize the mix for use in the hydrogen peroxide $SO_2$ gassing processes.

The following examples are provided for illustration only, and are not intended to be limiting with respect to the practice of the improvement in accordance with the present invention.

In the following examples all parts are expressed in parts by weight, all percents are expressed in percents by weight, all temperatures are expressed in °F., unless otherwise indicated.

EXAMPLE 1

Four 1000 part by weight batches of Wedron silica sand (5025) are each admixed respectively with 10 parts of a commercially available furan resin binder FD-777-22 (Trade designation of the Quaker Oats Company) plus 0.2 percent Ureido-silane A1160 (T.M. Union Carbide) based on the binder, and 15 parts of 50 percent hydrogen peroxide, based on the weight of the binder. In the first batch, the control procedure, one of the resulting sand mixes was tested after storage for the amount of time designated in Table I, i.e. it was placed in a shaping element and immediately gassed throughout with $SO_2$ gas for 0.5 seconds, and instantaneously purged with dry air for 20 seconds. The tensile strength of the resulting cured sand shape was determined immediately after gassing, upon removal of the cured sand shape from the shaping element.

The procedure set forth above is repeated in three more respective tests using the remaining three respective batches except that the above procedure, which is identified as the control procedure, is mofied in accordance with the present invention to include the addition of a stabilizer to the peroxide prior to blending as set forth in Table I. The amount of stabilizer which is added in each test is set forth under the stabilizer name in Table I and the amount is based on the weight of the binder. All stabilizers used in this test were added as 50 percent aqueous solutions.

TABLE I

| Time (Hours) | Tensile Strengths (Psi) Control | $NaH_2PO_4$ (10% BOB) | $NH_4H_2PO_4$ (10% BOB) | $H_3PO_4$ (2.5% BOB) |
|---|---|---|---|---|
| 2 | 175 | 245 | 285 | 300 |
| 4 | 0 | 265 | 255 | 290 |
| 6 | 0 | 200 | 235 | 210 |
| 8 | 0 | 105 | 175 | 160 |

Whereas the control provided about 175 pounds tensile immediately after gassing at 2 hours, it was useless immediately after gassing at 4 hours. On the other hand, the 10 percent sodium dihydrogen phosphate stabilized mix provided 245 psi tensile, the 10 percent ammonium dihydrogen phosphate stabilized mix provided 285 psi tensile, and the 2½ percent of 50-50 phosphoric acid stabilized mix provided about 300 psi tensile. At 4 hours the control didn't cure upon gassing and was totally useless, whereas the ammonium dihydrogen phosphate, sodium dihydrogen phosphate and phosphoric acid-treated mixtures all provided tensiles above 250 psi when gassed. Immediately after gassing at 8 hours the sodium dihydrogen phosphate-treated mixture still provided tensiles of about 105 psi, and the ammonium dihydrogen phosphate and phosphoric acid treated mixtures still provided tensiles substantially above 150 psi. The control was again useless (cure after gassing inadequate to permit handling to remove from pattern), when used at 8 hours.

EXAMPLE II

A relatively impure foundry sand which has been of very limited use with respect to the $SO_2$ gassing technology prior to the present invention is found to have substantial utility when the overall $SO_2$ gassing technology is improved in accordance with the present invention.

1000 Parts of an impure sand known as a Michigan lake sand is admixed with 15 parts of a commercially available furan resin identified as IDFS (T.M. Core-Lube, Inc.), and admixed with 15 percent hydrogen peroxide, based on the weight of the binder, and portions of the resulting mixture are placed and gassed at times specified in Table II and immediately tested for strength. The results are reported opposite the heading named "Control." In subsequent tests, otherwise identical to the control, a respective additive as described in Table II is added directly to the respective binders, and the resulting sand mixes are tested for psi tensile immediately after gassing (at the times set forth in Table II) with $SO_2$. The gassing step takes place after the lapse of time indicated on Table II, after the sand mix is made.

TABLE II

| | Psi Tensile When Gassed After Time Immediate | ½ hr. | ¾ hr. | 4 hr. | 6 hr. |
|---|---|---|---|---|---|
| Control | 110 | 70 | Too | — | — |
| 2.5%* (50/50 Aq. $H_3PO_4$) | 110 | 110 | 115 | 100 | Too soft |
| 5%* (50/50 Aq. $H_3PO_4$) | 120 | 130 | 125 | 115 | 100 |

*By weight based on the weight of the binder.

It is seen from the data on Table II that the control provided an immediate tensile strength of 110 psi when used in the $SO_2$ gassing procedure immediately after it was mixed, but within a very short period of time it would begin resulting in post-gassing sand shapes with less than 100 psi tensile. In fact, after only about ½ hour, the control material resulted, after $SO_2$ gassing, in sand shapes which were too soft to be handled. The mixture was useless when gassed at 4 hours and useless when gassed at 6 hours.

However, in accordance with the present invention, the $SO_2$ gassing technology is improved, even with the use of these relatively impure sands, by the addition of 1.25 percent (actual percent based on the binder) phosphoric acid so that for approximately ½ working shift, the sand mix produced from the highly impure sand provided tensiles of 100 psi or greater. The addition of a larger amount of the additive in accordance with the present invention to provide 2.5 actual percent phosphoric based on the weight of the binder extended the life in which at least 100 psi tensile could be achieved to at least 6 hours.

EXAMPLE III

This example illustrates that iron chelating agents having a basic pH are ineffective bench life extenders and are not in the class of stabilizers which are in accordance with the present invention.

In Table III, Part A, Test 3-1 is a control test in which the binder-sand-peroxide mix contains no stabilizer. Tests 3-2 through 3-4, are tests in which the mix contains varying levels of sodium saccharin, a proven basic pH iron chelating agent. Tests 3-1 through 3-4 are not in accordance with this invention and are provided for comparison purposes only.

In Part B, Test 3-5, is a control containing no stabilizer. For comparison, Test 3-6 contains phosphoric acid an acidic pH iron chelating agent as the stabilizer, and is thus in accordance with the present invention. Tests 3-7 and 3-8, contain 8-hydroxyquinoline, a commonly known alkaline pH, iron chelating agent added in various levels to the binder-sand-peroxide mix and thus tests 3-7 and 3-8 are not in accordance with the present invention and are provided for comparison purposes only.

In each respective test in Part A, a binder stabilizer mix was prepared as follows: One hundred parts of a commercially available furan resin binder FB777 (T.M. of The Quaker Oats Company) containing 0.2 percent (based on the binder), A1160 Ureido-silane (T.M. Union Carbide Co.) is blended with 1.5 parts of a 50 percent solution of hydrogen peroxide. Aliquot parts of this binder-peroxide mix are thoroughly blended with a respective iron chelating agent to provide the concentrations listed on Table III for the respective aliquots.

In each test in Part B a binder-sand-peroxide mix is prepared as follows: One hundred parts of a commercially available furan-containing binder designated as "IDFS" (Trade Designation of Corelube, Inc.) containing 3 percent of a silane separately provided by Corelube for use with IDFS binder, is mixed with 15 parts of a 50 percent solution of hydrogen peroxide in water and then with the respective stabilizers set forth in Table III in the respective amounts set forth in Table III.

The respective binder-stabilizer-peroxide mixes of Part A or Part B are then respectively blended with respective 1000 parts batches of Wedron 5025 silica sand in the amounts indicated in the Table. After the periods of bench time indicated on Table III, portions of the final mixes are rammed into a respective shaping element to form tensile strength specimen biscuits, and immediately gassed throughout by $SO_2$ gas (at 30 psi) for 0.5 seconds and instantaneously purged with dry air (at 30 psi) for 20 seconds. The tensile strengths of each of the resulting cured tensile biscuits were determined after gassing, immediately upon removal of the cured shape from the shaping element. The results of the tests are listed in Table III below.

TABLE III

| Test # | Sodium Saccharin (%)[a] | 8-Hydroxy-quinoline (15% Solution in MEOH) (%)[a] | $H_3PO_4$ 50% Aq. (%)[a] | Tensile Strengths (Psi)[e] Time (Mins.) 30 | 60 | 90 | 120 | 150 | 180 |
|---|---|---|---|---|---|---|---|---|---|
| Part A | | | | | | | | | |
| 3-1[b] | — | — | — | 240 | — | — | — | — | — |
| [c] | | | | | | | | | |
| 3-2[c] | 0.1 | — | — | 230 | 175 | — | — | — | — |
| 3-3[c] | 1.0 | — | — | 240 | 225 | 210 | — | — | — |
| 3-4[c] | 10.0 | — | — | 195 | 210 | — | — | — | — |
| Part B | | | | | | | | | |
| 3-5[b] | — | — | — | 165 | 155 | 145 | 135 | — | — |
| [c] | | | | | | | | | |
| 3-6[d] | — | — | 25 | 155 | 160 | 165 | 170 | 170 | 165 |
| 3-7[c] | — | 1 | — | 95 | 135 | 100 | 70 | 40 | — |
| 3-8[c] | — | 10 | — | 90 | — | — | — | — | — |

[a]based on the weight of the binder
[b]contains no stabilizer - Control
[c]not in accordance with the present invention
[d]in accordance with the present invention
[e]dashed lines in the Psi column indicate the gassed biscuit was too soft to be handled.

EXAMPLE IV

This example illustrates the effectiveness of two acidic iron chelating agents, Dequest 2010 (T.M. of Monsanto Company) and Mobil PA-75 phenyl phosphonic acid (T.M. of Mobil Oil Products), as stabilizers in accordance with the present invention.

Test 4-1 is a control test containing no stabilizer and thus is not in accordance with the present invention. This is provided for comparison purposes. Test 4-2 is similar to that set forth in the previous examples, and thus provides a basis for further comparison. Test 4-2 uses 2.5 percent phosphoric acid (based on the weight of the binder) as the stabilizer and is in accordance with the invention. Tests 4-3 and 4-4 employ Dequest 2010 in levels of 2.5 percent and 5.0 percent respectively as a stabilizer. Tests 4-5 and 4-6 contain 2.5 percent and 5.0 percent respectively of Mobil PA-75 phenyl phosphoric acid. Thus, tests 4-2 through 4-6 are in accordance with the present invention.

In each test the stabilizer, in the amount indicated on Table IV, is initially admixed with the sand, and then admixed with hydrogen peroxide (15 percent based on the weight of the binder), added to the resulting mixture. Finally the resulting mix is blended with IDFS (T.M. of Corelube, Inc.) furan binder which contains 3 parts of the silane additive referred to in the previous example to provide a 1.25 percent binder based on sand. The amount of mixing to which the blend is subjected is the minimum amount which results in an uniform mixture of the ingredients. When the mixing is completed, the time starts for the measured bench time which is reported under the "time" column in Table IV.

Tensile strength specimen biscuits are prepared and gassed with $SO_2$ at the times set forth in Table IV, and the resulting gassed mix is immediately tested for tensile strength. The results are reported in Table IV.

TABLE IV

| | TENSILE STRENGTHS (PSI)[a] | | | | | |
|---|---|---|---|---|---|---|
| Time (Min) | (#4-1) Control* | (#4-2) 2.5% $H_3PO_4$ | (#4-3) 2.5% Dequest 2010 | (#4-4) 5.0% Dequest 2010 | (#4-5) 2.5% Mobil PA-75 | (#4-6) 5.0% Mobil PA-75 |
| 30 | 155 | 165 | 155 | 200 | 175 | 180 |
| 60 | 160 | 180 | 160 | 210 | 185 | 190 |
| 90 | 170 | 195 | 170 | 220 | 190 | 190 |
| 120 | 165 | 205 | 175 | 215 | 180 | 190 |
| 150 | 135 | 210 | 180 | 210 | 175 | 195 |
| 180 | 100 | 200 | 180 | 200 | 175 | 200 |
| 210 | — | 195 | 180 | 195 | 175 | 195 |
| 240 | — | 185 | 175 | 185 | 165 | 180 |
| 270 | — | 175 | 155 | 175 | 160 | 165 |
| 300 | — | 165 | 135 | 160 | 150 | 150 |
| 330 | — | 155 | 125 | 155 | 150 | 135 |
| 360 | — | 150 | 125 | 150 | 145 | 120 |
| 390 | — | 135 | 120 | 140 | 125 | 105 |
| 420 | — | 115 | — | 120 | — | — |

*Contains no stabilizer - not in accordance with the present invention

[a]A dashed line under the Tensile Strength column indicates that immediately after $SO_2$ gassing the sample was too soft to be handled

EXAMPLE V

This example further illustrates the use of salts in accordance with the present invention as bench life additives. (Example I showed a comparison of sodium and ammonium salts of phosphoric acid.)

In this example, the use of commercially available iron chelating agent Dequest 2000, (T.M. Monsanto) an aminotri methylene phosphonic acid having an acidic pH of less than 2 in a 1 percent R.T. solution, and its penta sodium salt Dequest 2006 (T.M. Monsanto), which has a pH of 10–11 in a 1 percent R.T. solution, are illustrated.

In this example, an acid catalyzable furan resin is admixed with Wedron silica sand to provide 1 percent binder on the sand, based on sand weight, and sufficient silane (A-1160) to provide 0.2 percent based on binder. Then sufficient hydrogen peroxide is added to provide 15 percent based on binder, and stabilizer as set forth in this example is added to provide 0.25 percent based on the binder. When mixing is completed the time starts for measuring of "bench time." At the times indicated in Table V, the mixes in the shape of tensile strength test bisquits, were gassed with $SO_2$ for 0.5 seconds, and purged with air at 20 seconds. Immediately thereafter, the tensiles were measured and the results are reported in Table V.

TABLE V

| | IMMEDIATE PSI TENSILE | |
|---|---|---|
| Bench Time | Acid Form | Na Salt Form |
| Immediate | 210/87 | 220/86 |
| 5 hours | 155/67 | 185/68 |
| 6 hours | Too soft | Too soft |

Thus, it can be appreciated from the above examples, that the acidic useful life additives in accordance with the present invention do indeed increase the useful life of hydrogen peroxide-containing sand mixes for $SO_2$ gas curing. However, it is appreciated that the concentrations of the additive which are added in accordance with the present invention are, objectively speaking, extremely low and surprisingly even though relatively acidic, the useful life extenders which are added in accordance with the present invention function as stabilizers or life extenders. It is important that the level of mix stabilizer which is employed, in accordance with the present invention, be sufficiently high to stabilize the mixture, but sufficiently low that substantially no polymerization of the acid polymerized furan resin binders results. Ordinarily speaking, the phosphoric acid can be added to these binders at a level of up to about 10 percent based on the weight of the binder before any significant polymerization is observed during the useful level life. If the phosphoric acid is added at levels in the neighborhood of 10 percent, after a period of 18–20 hours, the mixture will be observed to be polymerizing to such an extent that it will be regarded as "setting up." Thus, catalyzing levels of above 10 percent or higher of phosphoric acid are to be avoided, in accordance with the practice of the present invention, whereas levels substantially below that e.g. levels below 10 percent are preferably below 5 percent (BOB) are found to be extremely useful as stabilizing amounts which are "non-catalytic," in accordance with this invention.

It is to be understood, of course, that if the ULA which is added in accordance with the present invention is $P_2O_5$, phosphoric acid is instantly produced when water is added and relatively copious levels of water are normally added by way of the hydrogen peroxide ingredient. The amounts of $P_2O_5$ which would be required to provide a given level of phosphoric acid would be substantially lower on a weight-weight basis than, for example, a 50:50 aqueous $H_3PO_4$ ingredient.

Although it is not essential that the mixing time for the preparation of the stabilized hydrogen peroxide-containing sand mixes be the minimum time necessary to give a uniform blend of the ingredients, it is a preferred practice to use the minimum mixing time. In fact, in the most preferred commercial practice of the present invention, a continuous mixer providing very efficient mixing in very short mixing times, is used.

The principles behind the success of the present invention are not as yet fully understood. However, based on our repeated observation, it appears that abrasion of the sand at the iron-containing walls of the mixing vessels may result in the presence of minute, trace quantities of finely divided, if not colloidal, reduced iron in the hydrogen-peroxide-containing sand mix, and that within a short period of time, this may result in the destruction of the hydrogen-peroxide in mixes which are not stabilized in accordance with this invention. This may also account for the substantial bench life improvement found in some "poor" iron-containing sands which do not have high acid demand, using this invention.

From a consideration of the examples, it will be appreciated that the individual ingredients, in accordance with this invention, can be added individually or as pre mixes. The peroxide, binder, and ULA can be added to each other, or the peroxide and ULA can be added to each other prior to addition to the binder. In addition, the mixing sequence is not essential, although the sequence (sand, stabilizer, binder, silane, peroxide) is entirely satisfactory. Also the sequence (sand, binder, silane, blend of peroxide and ULA) is also satisfactory. Likewise (sand, ULA, peroxide, binder, silane) is also satisfactory.

We claim:

1. In a foundry sand mix comprising a mixture of sand, acid polymerized furan resin binder, and hydrogen peroxide, the improvement wherein the mixture includes a bench life stabilizing, non-catalytic amount, less than 5 percent by weight based on the weight of the binder, of an iron chelating agent having a log $K_{(stab)}$ greater than 15, and selected from the iron chelating agents which are acids and salts of acids selected from those which, in their acid form have an acidic pH less than 3 when dissolved at 1 percent weight per weight in water or when saturated in water, whichever is lower in concentration.

2. The stabilized foundry mix of claim 1 wherein the chelating agent is phosphoric acid.

3. The foundry sand mix of claim 1 wherein the chelating agent is sodium dihydrogen phosphate.

4. The foundry sand mix of claim 1 wherein the chelating agent is phenyl phosphonic acid.

5. The foundry sand mix of claim 1 wherein the chelating agent is hypo-phosphorus acid.

6. The foundry sand mix of claim 1 wherein the iron chelating agent is phenyl phosphonic acid, penta sodium salt.

7. The foundry sand mix of claim 1 wherein the iron chelating agent is 1-hydroxyethylidene-1, 1-diphosphonic acid.

8. The foundry sand mix of claim 1 wherein the iron chelating agent is aminotri(methylene-phosphonic)acid.

9. A method for extending the bench life of a freshly prepared foundry sand mix comprising sand, acid polymerized furan resin binder and hydrogen peroxide which comprises:

including in the foundry sand mix a non-catalytic, effective bench life stabilizing amount, less than 5 percent by weight based on the weight of the binder, of an iron chelating agent having a log $K_{(stab)}$ greater than 15, and wherein the chelating agent is selected from the iron chelating agents which are acids or salts of acids selected from those which, in their free acid form have an acidic pH less than 3 when dissolved at 1 percent weight per weight in water or when in a saturated solution in water, whichever is lower in concentration.

10. The method of claim 9 wherein the iron chelating agent is sodium dihydrogen phosphate.

11. The method of claim 9 wherein the iron chelating agent is phosphoric acid.

12. The method of claim 9 wherein the iron chelating agent is phosphorus acid.

13. The method of claim 9 wherein the iron chelating agent is phenyl phosphonic acid.

14. A method of manufacturing a foundry sand mix comprising sand, binder and hydrogen peroxide, which method results in a sand mix having improved bench life, comprising:

admixing foundry sand, acid polymerized furan resin binder, silane, hydrogen peroxide, and a non-catalytic, effective bench life stabilizing amount, less than 5 percent by weight based on the weight of the binder, of an iron chelating agent having a log $K_{(stab)}$ greater than 15, and wherein the chelating agent selected from the iron chelating agents which are acids or salts of acids selected from those which, in their free acid form, have an acidic pH less than 3 when dissolved at 1 percent by weight in water or when saturated in water, whichever is lower in concentration wherein the mixing is performed over a period of time which is the minimum amount necessary to provide a uniform blend of the ingredients.

15. The method of manufacturing a foundry mix comprising sand, binder and hydrogen peroxide, which method results in a sand mix having an improved bench life with respect to the subsequent $SO_2$ gassing curing of same, the method comprising:

admixing in a continuous mixer the ingredients sand, acid catalyzed furan resin binder, silane, hydrogen peroxide, and a non-catalytic effective bench life stabilizing amount, less than 5 percent by weight based on the weight of the binder, of an iron chelating agent having a log $K_{(stab)}$ greater than 15, and wherein the chelating agent is selected from the iron chelating agents which are acids or salts of acids selected from those which, in their free acid form have an acidic pH less than 3 when dissolved at 1 percent by weight in water or when in a saturated solution in water, whichever is lower in concentration, and wherein the residence time in the continuous mixer is the minimum time which is necessary to achieve an uniform blend of the ingredients.

16. The method of claim 15 wherein the iron chelating agent is sodium dihydrogen phosphate.

17. The method of claim 15 wherein the iron chelating agent is phosphoric acid.

18. The method of claim 15 wherein the iron chelating agent is phosphorus acid.

19. The method of claim 15 wherein the iron chelating agent is phenyl phosphonic acid.

20. In a foundry sand mix comprising a mixture of sand, acid polymerized furan resin binder, and hydrogen peroxide, the improvement wherein the mixture includes a bench life stabilizing, non-catalytic amount, less than 5 percent by weight based on the weight of the binder, of an iron chelating agent having a log $K_{(stab)}$ greater than 15, and selected from the iron chelating agents which are acids and salts of acids selected from those which, in their acid form have an acidic pH less than 3 when dissolved at 1 percent weight per weight in water or when saturated in water, whichever is lower in concentration, said iron chelating agent having the chemical structure

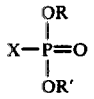

wherein: R and R′ is hydrogen or metal irons which result in the structure providing a water soluble compound, and X is OH or an organic moiety including alkyl substitutents or aromatic substitutents.

21. A method for extending the bench life of a freshly prepared foundry sand mix comprising sand, acid polymerized furan resin binder and hydrogen peroxide which comprises:

including in the foundry sand mix a non-catalytic effective bench life stabilizing amount, less than 5 percent by weight based on the weight of the binder, of an iron chelating agent having a log $K_{(stab)}$ greater than 15, and wherein the chelating agent is selected from the iron chelating agents which are acids or salts of acids selected from those which, in their free acid form have an acidic pH less than 3 when dissolved at 1 percent weight per weight in water or when in a saturated solution in water, whichever is lower in concentration, and wherein the iron chelating agent has the chemical structure

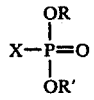

wherein: R and R′ is hydrogen or metal ions which result in the structure providing a water soluble compound, and X is OH or an organic moiety including alkyl substituents or aromatic substituents.

* * * * *